US008475206B2

(12) United States Patent
Kubo

(10) Patent No.: US 8,475,206 B2
(45) Date of Patent: Jul. 2, 2013

(54) COAXIAL CONNECTOR AND METHOD FOR ASSEMBLING THE SAME

(75) Inventor: Takafumi Kubo, Tokyo (JP)

(73) Assignee: Tyco Electronics Japan G.K., Kanagawa-Ken (JP)

( * ) Notice: Subject to any disclaimer, the term of this patent is extended or adjusted under 35 U.S.C. 154(b) by 0 days.

(21) Appl. No.: 13/370,593

(22) Filed: Feb. 10, 2012

(65) Prior Publication Data

US 2012/0142211 A1 Jun. 7, 2012

Related U.S. Application Data

(63) Continuation of application No. PCT/JP2010/004725, filed on Jul. 23, 2010.

(30) Foreign Application Priority Data

Aug. 10, 2009 (JP) ..... 2009-186041

(51) Int. Cl.
*H01R 13/28* (2006.01)

(52) U.S. Cl.
USPC ..... 439/582

(58) Field of Classification Search
USPC ..... 439/582, 585, 394, 63
See application file for complete search history.

(56) References Cited

U.S. PATENT DOCUMENTS

| | | | | |
|---|---|---|---|---|
| 5,263,877 | A * | 11/1993 | Mitani | 439/585 |
| 6,572,407 | B1 * | 6/2003 | Ko | 439/582 |
| 6,790,082 | B2 | 9/2004 | Obayashi | |
| 7,938,681 | B2 * | 5/2011 | Lee et al. | 439/582 |
| 2010/0151729 | A1 * | 6/2010 | Chen et al. | 439/585 |

OTHER PUBLICATIONS

International Search Report of co-pending International Application No. PCT/JP2010/004725, dated Sep. 7, 20101, 2 pages.
PCT International Preliminary Report on Patentability, International Application No. PCT/JP2010/004725, dated Mar. 13, 2012, 5 pages.

* cited by examiner

*Primary Examiner* — Gary F. Paumen
(74) *Attorney, Agent, or Firm* — Barley Snyder

(57) ABSTRACT

A coaxial connecter and a method for assembling the same are provided, in which there is little variation in the amount of holding an inner conductor between connection terminals and the connection between the inner conductor and the connection terminals is achieved with high reliability. The coaxial connector includes a housing, an inner contact, and an outer contact. The inner contact is secured to the housing and includes a conductor mounting portion and a conductor holding arm with a lock. The conductor holding arm is integrally formed with the conductor mounting portion. The outer contact is secured to the housing, as well. Either the housing or the conductor mounting portion is provided with a holding portion into which the lock is press-fitted when the conductor holding arm is folded toward the conductor mounting portion.

11 Claims, 10 Drawing Sheets

COAXIAL CONNECTOR AND METHOD FOR ASSEMBLING THE SAME

CROSS-REFERENCE TO RELATED APPLICATION

This application is a continuation of PCT International Application No. PCT/JP2010/004725 filed Jul. 23, 2010, which claims priority under 35 U.S.C. §119 to Japanese Patent Application No. 2009-186041, filed Aug. 10, 2009.

FIELD OF THE INVENTION

The present invention relates to a connector and, in particular, to a coaxial connector for use in a mobile telephone, an information equipment such as notebook computer, and a small-sized electronic device such as a household electrical appliance.

BACKGROUND

Conventionally, in a coaxial connector, an inner conductor of a coaxial cable and a connection terminal of the coaxial connector are often connected together through soldering. However, if there is a change in the amount of solder used in the connection, there is a problem that the characteristic impedance is different from a desired value. Besides, since the solder includes lead in many cases, it is desirable that soldering be limited in consideration of the environmental issues at the time of disposal.

Therefore, known coaxial connectors shown in FIG. 10 and FIG. 11 are disclosed that does not use the solder in the connection between the inner conductor and the connection terminal (see JP 2002-324636 A).

As shown in FIG. 10, this known coaxial connector 101 includes an insulating portion 103, a connection terminal 102 secured to the insulating portion 103, and a metal shell 104. The connection terminal 102 is connected to an inner conductor 134 of a coaxial cable 131, and the shell 104 movably supports the connection terminal 102 using the insulating portion 103.

The connection terminal 102 includes a pair of opposing contacts 102*a* and 102*b* formed from a metal plate spring and into a letter V shape. In the pair of contacts 102*a* and 102*b*, one contact 102*a* is secured to the insulating portion 103. In addition, the shell 104 is composed of a shell main body 104*a*, a shell folding portion 104*b*, a first engaging tongue portion 104*c*, a second engaging tongue portion 104*d*, and a third engaging tongue portion 104*e*. The shell main body 104*a* supports an insulating portion main body 103*a* of the insulating portion 103. The shell folding portion 104*b* is arranged side by side with an insulation folding portion 103*b* of the insulating portion 103, and is folded together with the insulation folding portion 103*b*. The first engaging tongue portion 104*c* is provided at each side of the shell folding portion 104*b*.

In the coaxial connector 101, the shell folding portion 104*b* and the insulation folding portion 103*b* are folded toward the shell main body 104*a* and the insulating portion main body 103*a* at the same time. Then, the other contact 102*b* included in the connection terminal 102 pushes the inner conductor 134 to one contact 102*a* with each of folding forces of the shell folding portion 104*b* and insulation folding portion 103*b* (see FIG. 11). Hence, the pair of the contacts 102*a* and 102*b* elastically deform and hold the inner conductor 134 of the coaxial cable 131. On the other hand, the first engaging tongue portion 104*c* is crimped onto the insulating portion main body 103*a*, and the shell main body 104*a*, the second engaging tongue portion 104*d* is crimped onto an outer conductor 133 of the coaxial cable 131. The third engaging tongue portion 104*e* is crimped onto an outer cover 132 of the coaxial cable 131. Accordingly, the inner conductor 134 of the coaxial cable 131 and the connection terminal 102 are electrically connected.

By employing the above configuration, it is no longer necessary to connect the inner conductor 134 to the connection terminal 102 by soldering. This solves the problem that the characteristic impedance is different from a desired value, which is caused by a variation in the used amount of the solder. This also solves the problem of the environmental issues at the time of disposal, which is brought by using the solder.

It is to be noted, however, that in the known coaxial connector described in JP 2002-324636 A, the shell folding portion 104*b* and the insulation folding portion 103*b* are folded so that the inner conductor 134 is held between the contacts 102*a* and 102*b*. Therefore, the amount of holding the inner conductor 134 is easily changeable. To be specific, the folded portions of the shell folding portion 104*b* and the insulation folding portion 103*b* change the pushing amount into the contact 102*b*. This easily results in variations in the amount of crimping the inner conductor 134 together with the contact 102*a*. If it is difficult to control the amount of holding the inner conductor 134, the connection reliability between the inner conductor 134 and the connection terminal 102 would be degraded.

SUMMARY

Therefore, the present invention has been made in view of the above-described problem, and has an object of providing a coaxial connector and an assembling method of the same, in which there is little variation in the amount of holding an inner conductor between connection terminals and the connection between the inner conductor and the connection terminal is achieved with high reliability.

The coaxial connector includes a housing, an inner contact, and an outer contact. The inner contact is secured to the housing and includes a conductor mounting portion and a conductor holding arm with a lock. The conductor holding arm is integrally formed with the conductor mounting portion. The outer contact is secured to the housing, as well. Either the housing or the conductor mounting portion is provided with a holding portion into which the lock is press-fitted when the conductor holding arm is folded toward the conductor mounting portion.

BRIEF DESCRIPTION OF THE DRAWINGS

The objects, features and advantages of the invention will become more apparent by describing in detail embodiments thereof with reference to the accompanying drawings, in which.

DETAILED DESCRIPTION OF THE EMBODIMENT(S)

Embodiments of the present invention will now be described with reference to the drawings.

Figure 1:
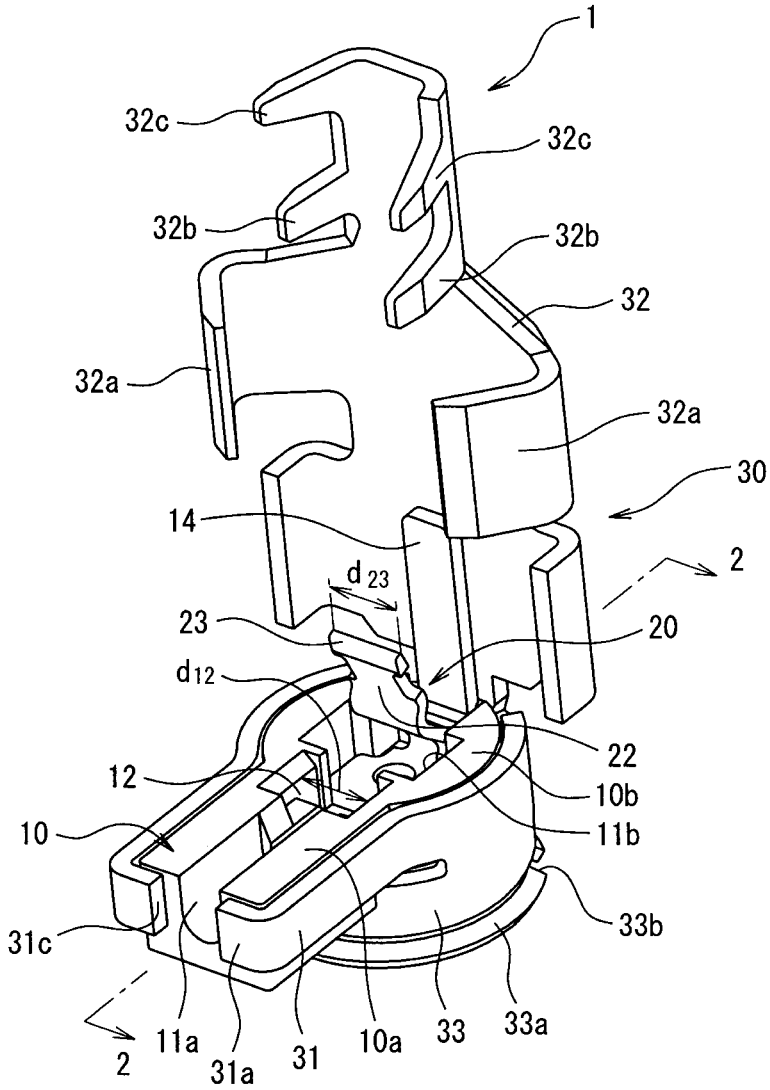
FIG. 1 is a perspective view a coaxial connector according to the invention.
Figure 2:
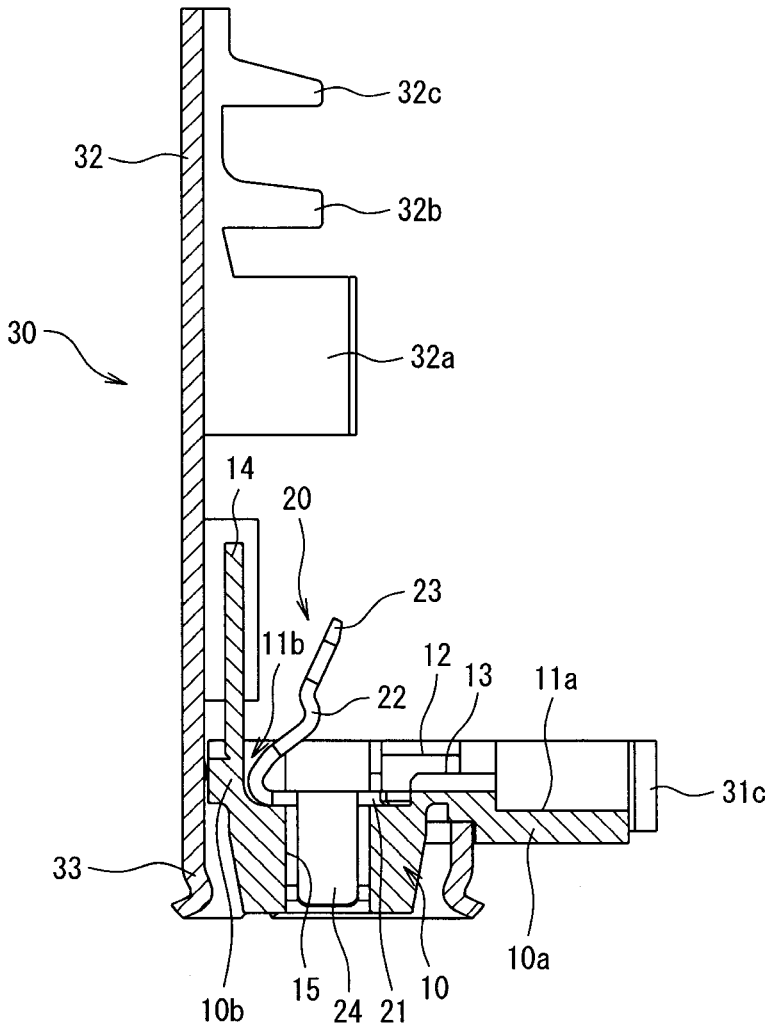
FIG. 2 is a cross-sectional view taken along line 2-2 of FIG. 1.

Referring to FIG. 1 and FIG. 2, a coaxial connector 1 is shown having a housing 10, an inner contact 20, and an outer contact 30.

The housing 10 is integrally formed of a material with electrical insulating properties (i.e. a synthetic resin), as shown in FIG. 1 and FIG. 2. The housing 10 includes a back portion 10*a* and a front portion 10*b*. The back portion 10*a* has a substantially rectangular parallelepiped shape, whereas the front portion 10*b* has a substantially cylindrical shape having an axis perpendicular to the length direction of the back portion 10*a*, in the shown embodiment. The thickness of the front portion 10*b* is greater than that of the back portion 10*a* (see FIG. 2).

The back portion 10*a* is provided with a first groove portion 11*a* having a semicircular cross-section, opening to the back side, and extending to correspond to the axial direction of a coaxial cable 50 and the length direction of the back portion 10*a*. The coaxial cable 50 is inserted into the first groove portion 11*a*.

Figure 7:
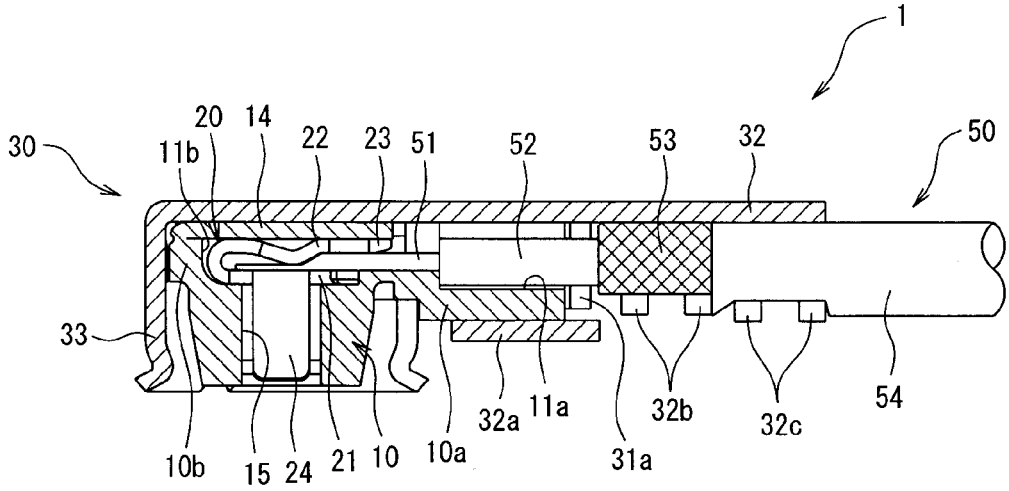
FIG. 7 is a perspective view of the coaxial connector according to present invention, showing the coaxial connector after the coaxial cable is interconnected.

The front portion 10*b* is provided with a second groove portion 11*b* having a rectangular shape for securing the inner contact 20, and a fit opening 15, to be received by the second groove portion 11*b*, and having a rectangular shape penetrating in the axial direction of the front portion 10*b* to the lower surface of the front portion 10*b* (see FIG. 7). As will be described later, contact pieces 24 of the inner contact 20 are disposed in the fit opening 15.

Additionally, as shown in FIG. 1, a holding portion 12 is arranged between the first groove portion 11*a* and the second groove portion 11*b* of the housing 10. The holding portion 12 is a rectangular groove arranged between the back portion 10*a* and the front portion 10*b* to be received therebetween and extending in a direction (width direction) perpendicular to the length direction of the back portion 10*a*. A dimension $d_{12}$ in the width direction of the holding portion 12 is designed to be same as or slightly smaller than a dimension $d_{23}$ in the width direction of a lock 23 (see FIG. 1 and FIG. 5). Thus, this allows the lock 23 to be press-fitted into the holding portion 12. In addition, the dimension in the length direction of the holding portion 12 may be any, as long as it is equal to or greater than a dimension in the length direction of the lock 23, to be described later.

Furthermore, the holding portion 12 is provided with a stopper 13 for defining the lowermost position in press-fitting of the lock 23, at the bottom surface of the holding portion 12 (see FIG. 2). The provision of the stopper 13 makes uniform the depth of press-fitting of the lock 23 into the holding portion 12, thereby reducing the variations in the press-fitting amount.

Figure 3A:
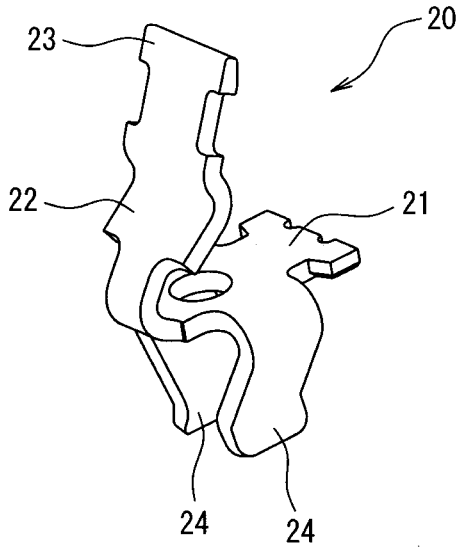
FIG. 3A is a perspective view of an inner contact for use in the coaxial connector shown in FIG. 1.
Figure 3B:
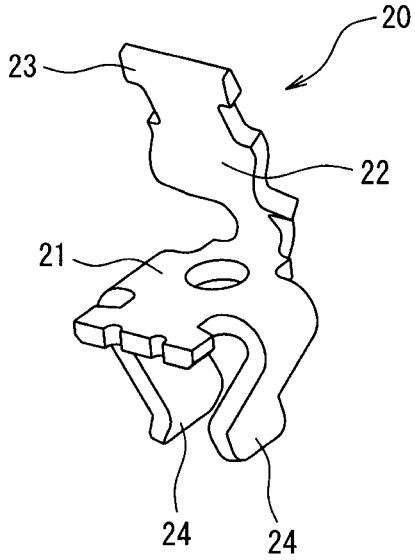
FIG. 3B is another perspective view the inner contact for use in the coaxial connector shown in FIG. 1.
Figure 4A:
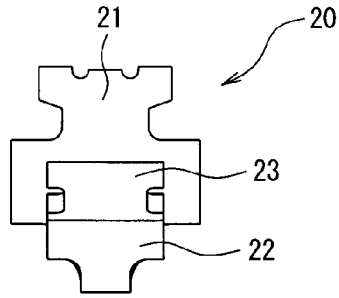
FIG. 4A is a plan view the inner contact shown in FIG. 3.
Figure 4B:
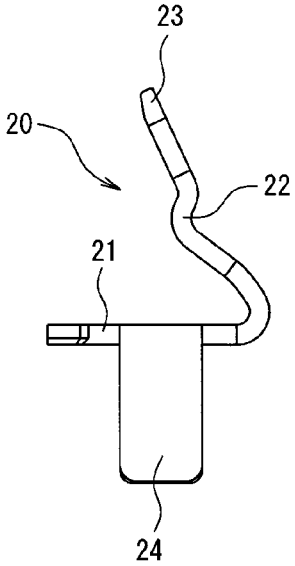
FIG. 4B is a left side view the inner contact shown in FIG. 3.
Figure 4C:
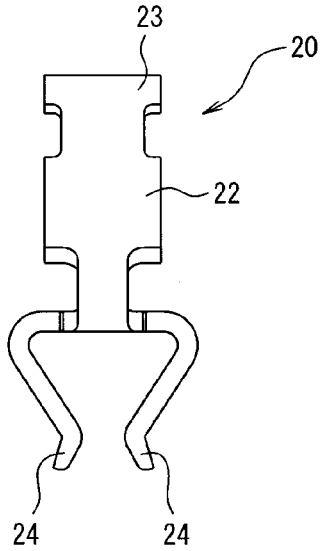
FIG. 4C is a front view the inner contact shown in FIG. 3.
Figure 4D:
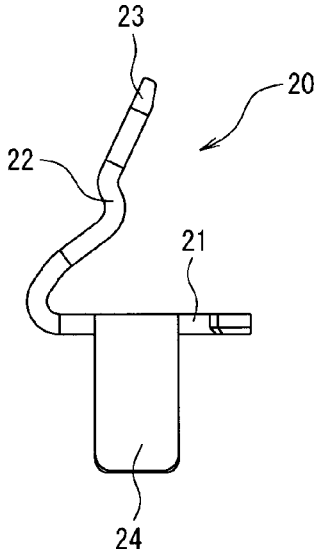
FIG. 4D is a right side view the inner contact shown in FIG. 3.
Figure 4E:
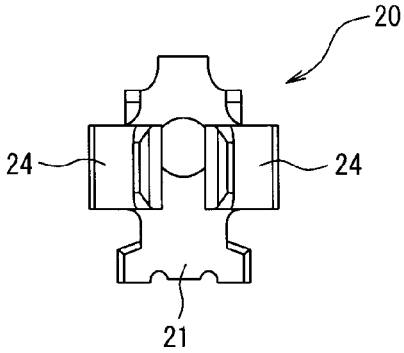
FIG. 4E is a bottom view the inner contact shown in FIG. 3.

Referring to FIGS. 3A and FIG. 4E, the inner contact 20 is formed by stamping and forming a metal plate. The inner contact 20 is secured to the second groove portion l lb such as to be connected to an inner conductor 51 exposed from the coaxial cable 50 that is inserted into the first groove portion 11 a of the housing 10 (see FIG. 1 and FIG. 5).

Additionally, as shown in FIG. 1 to FIG. 4E, the inner contact 20 includes a conductor mounting portion 21, a conductor holding arm 22, and a pair of contact pieces 24. The conductor mounting portion 21 has a rectangular plate shape extending in front-back direction. The conductor holding arm 22 has a plate shape, and is integrally formed with the front side of the conductor mounting portion 21. The pair of contact pieces 24 are integrally formed with the conductor mounting portion 21, and are arranged on both sides of the conductor mounting portion 21. The inner conductor 51 of the coaxial cable 50 is disposed on the conductor mounting portion 21. The conductor holding arm 22 is curved toward the conductor mounting portion 21 side, so that its cross-sectional shape has a letter S, as shown in FIG. 4B and FIG. 4D. The contact pieces 24 are electrically connected to a mating contact of a mating connector (not shown). The conductor holding arm 22 is bent upwardly with respect to the conductor mounting portion 21, whereas the pair of the contact pieces 24 are respectively bent downwardly with respect to the conductor mounting portion 21. The contact pieces 24 respectively bent downwardly are, as shown in FIG. 4C, bent in directions of getting closer to each other when viewed from the front surface so as to be connected in a deflecting manner to the mating contact of the mating connector (not shown).

An end of the conductor holding arm 22 is provided with the lock 23 protruding in the width direction.

Figure 5:
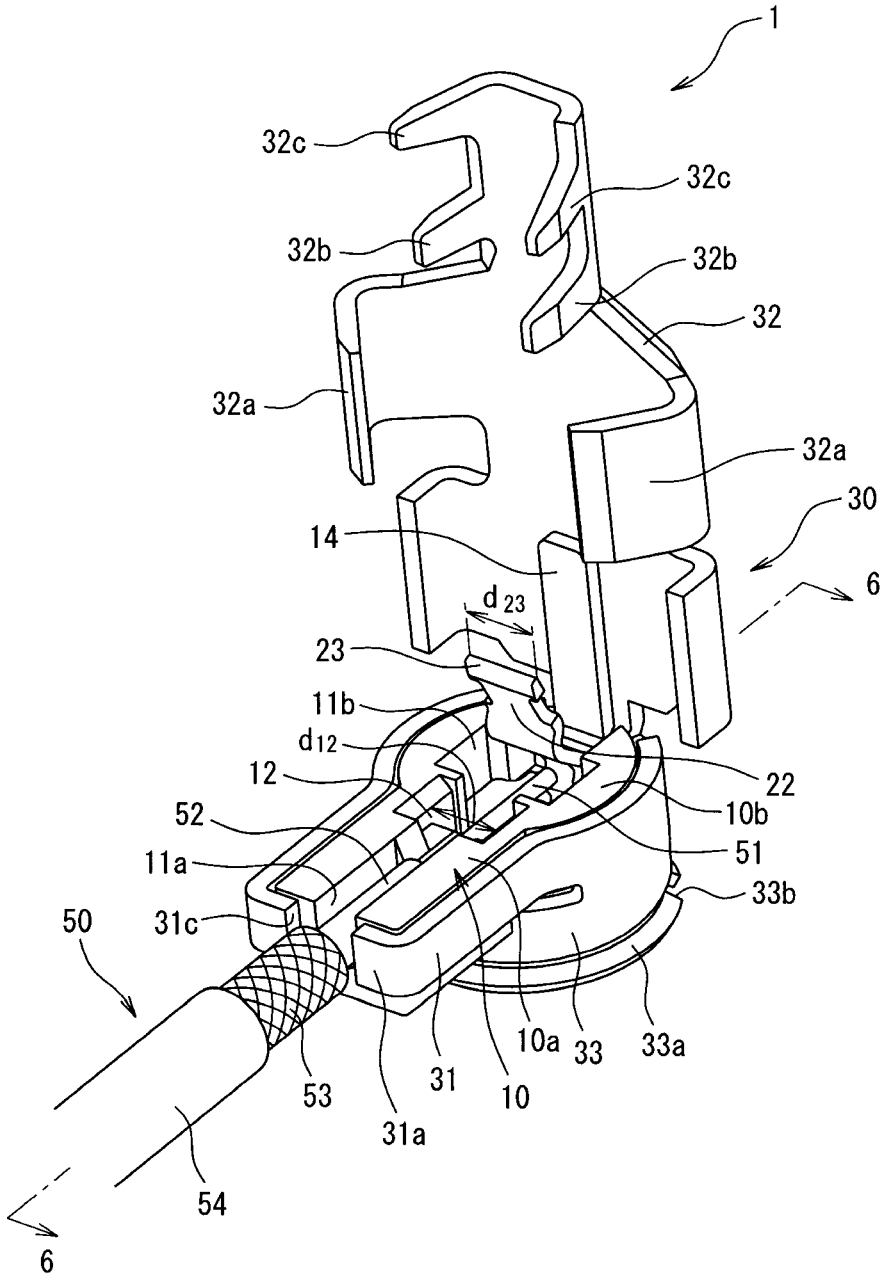
FIG. 5 is another perspective view of the coaxial connector according to the invention, showing to a coaxial cable is mounted thereon.
Figure 6:
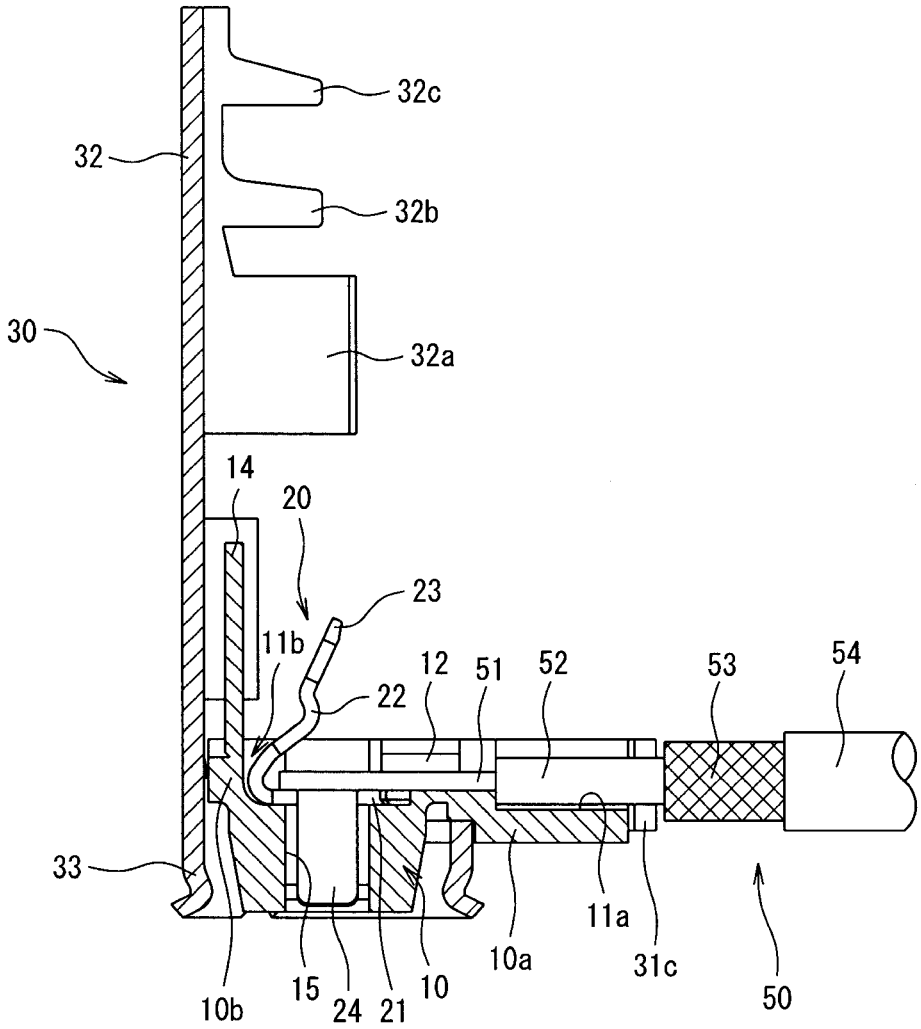
FIG. 6 is a cross-sectional view taken along line 6-6 of FIG. 5.

Referring to FIG. 5 and FIG. 6, the conductor holding arm 22 is further bent toward the conductor mounting portion 21, when the inner conductor 51 of the coaxial cable 50 is positioned on the conductor mounting portion 21. In this situation, the lock 23 of the inner contact 20 is press-fitted into the holding portion 12 formed in the housing 10. Since a dimension $d_{23}$ in the width direction of the lock 23 is set to be equal to or greater than the dimension $d_{12}$ in the width direction of the holding portion 12 (see FIG. 1 and FIG. 5), the inner conductor 51 is secured by the conductor mounting portion 21 and the conductor holding arm 22.

In this way, the conductor holding arm 22 is bent toward the conductor mounting portion 21 to hold the inner conductor 51, and in addition, the lock 23 is press-fitted into the holding portion 12. It is therefore possible to reduce variations in the amount of holding the inner conductor 51 in the inner contact 20.

As a result, it is possible to provide the coaxial connector 1 with high reliability in the connection of the inner conductor 51 and the connection terminal (the inner contact 20).

The outer contact 30 is secured to the outer edge surface of the housing 10, and is connected to an outer conductor 53 of the coaxial cable 50.

The outer contact 30 is formed by stamping and forming a metal plate. The outer contact 30 includes a shell 31 that extends in an axial direction of a groove portion 11, and a cover 32 integrally formed with the shell 31, folded toward the shell 31, and holding the housing 10 together with the shell 31. The shell 31 is composed of a frame portion 31*a* disposed along the outer shape of the back portion 10*a*, and a mating portion 33 having a substantially cylindrical shape, in which both side edges are partially enlarged to have an arc shape corresponding to the circular outer shape of the front portion 10*b*, to be mated with the mating connector. The frame portion 31*a* is formed with an receiving passageway 31*c* that communicates with the first groove portion 11*a* and permits insertion of a dielectric body 52 of the coaxial cable 50. An end portion 33*a* in the axial direction of the mating portion 33 (an end portion to be fit into the mating connector, not shown) is provided with a plurality of notches 33*b* circumferentially, each extending in up-down direction, for giving flexibility to the mating portion 33.

In addition, the shell cover 32 is provided with crimping pieces 32*a*, 32*b*, and 32*c*. The crimping pieces 32*a* are crimped to the shell 31 and the back portion 10*a* of the housing 10. The crimping pieces 32*b* are adjacently arranged to the crimping pieces 32*a* to be crimped to the outer conductor 53 of the coaxial cable 50. The crimping pieces 32*c* are adjacently arranged to the crimping pieces 32*b* to be crimped to an outer sheath 54 of the coaxial cable 50. After the shell cover 32 is folded toward the shell 31, the crimping pieces 32*a* extend downwardly from the both side edges of the shell cover 32 to be ready for receiving the shell 31 and the back portion 10*a*, before being crimped to the outer conductor 53. After the shell cover 32 is folded toward the shell 31, the crimping pieces 32*b* extend downwardly from the both side edges of the shell cover 32 to be ready for receiving the outer sheath 54 before being crimped to the outer sheath 54.

In this situation, a cover portion 14 extending up to oppose the inner surface side (a surface opposing the shell 31) of the shell cover 32 is arranged on the front side of the housing 10. The cover portion 14 supports the conductor holding arm 22 of the inner contact 20, when the shell cover 32 is folded toward the shell 31. The provision of the cover portion 14 supports the conductor holding arm 22 that holds the inner conductor 51 with the conductor mounting portion 21 from the top thereof, thereby improving the connection reliability between the inner conductor 51 and the inner contact 20.

Furthermore, as shown in FIG. 5 and FIG. 6, the coaxial cable 50 includes the inner conductor 51, the dielectric body 52 for accommodating the inner conductor 51, the outer conductor 53 for covering the outer circumference of the dielectric body 52, and the outer sheath 54 with insulating properties for covering the outer circumference of the outer conductor 53. The inner conductor 51 exposed at an end of the dielectric body 52 is held by the conductor mounting portion 21 and the conductor holding arm 22. The outer conductor 53 is, for example, a braid with copper as a material, but may be a winding wire or a conductive foil.

Next, an assembling method of the coaxial connector according to the invention will be described with reference to the drawings.

The assembly of the coaxial connector according to the invention includes a mounting step, a holding step, and a connecting step. Specifically, in a case where the outer contact 30 does not have the shell 31 secured to the housing 10 or the shell cover 32 integrally formed with the shell 31, the connecting process is not always necessary.

Firstly, in the coaxial connector 1 having the above described configuration, the inner conductor 51 of the coaxial cable 50 is mounted on the conductor mounting portion 21 of the inner contact 20 secured to the housing 10.

Next, the conductor holding arm 22 provided with the lock 23 is folded toward the conductor mounting portion 21 on which the inner conductor 51 is mounted, so that the lock 23 of the conductor holding arm 22 is press-fitted into the holding portion 12 arranged in the housing 10. In this way, the holding state of the inner conductor 51 is maintained by the conductor mounting portion 21 and the conductor holding arm 22.

Then, the shell cover 32 is folded toward the shell 31 to crimp the pair of the crimping pieces 32*a* onto the shell 31 and the housing 10, and in addition, the pair of the crimping pieces 32*b* are crimped onto the outer conductor 53, and the pair of the crimping pieces 32*c* are crimped onto the outer sheath 54 (see FIG. 7). In this situation, since the cover portion 14 arranged on the front side of the housing 10 supports the conductor holding arm 22 holding the inner conductor 51 together with the conductor mounting portion 21 from the top thereof, the connection reliability between the inner conductor 51 and the inner contact 20 is improved.

In this way, the lock 23 is press-fitted into the holding portion 12, so that the inner conductor 51 is held by the conductor mounting portion 21 and the conductor holding arm 22. Thus, the amount of holding the inner conductor 51 in the inner contact 20 has little variation. Accordingly, it is possible to provide the coaxial connector 1 having high connection reliability between the inner conductor 51 and the inner contact 20.

Next, another embodiment will be described with reference to FIG. 8. In the shown embodiment, only the configurations of the lock and the holding portion are different from those of the embodiment described above. Therefore, descriptions of the configurations common to those of the aforementioned embodiment will be omitted for sake of brevity.

Figure 8A:
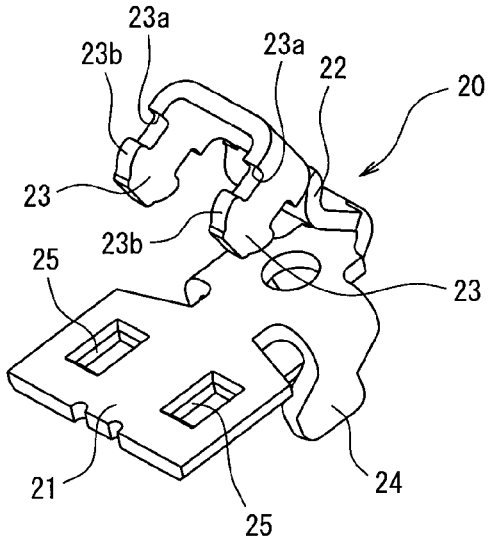
FIG. 8A is a perspective view another inner contact according to the invention.
Figure 8B:
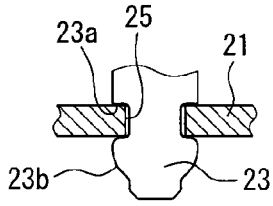
FIG. 8B is a cross-sectional view of a holding portion of the inner contact.

Referring to FIG. 8, in the shown embodiment, each lock 23 protruding in the width direction of the conductor holding arm 22 is bent toward the conductor mounting portion 21 side. In addition, each lock 23 is provided with a stopper 23*a* that extends in a direction perpendicular to the folded direction, and a protruding portion 23*b*, such as a barb, that protrudes in the same direction, such that the stopper 23*a* and the protruding portion 23*b* are arranged in this order as closer to the end thereof.

On the other hand, the conductor mounting portion 21 is provided with the holding portion 25 into which the lock 23 that has been bent is inserted, so that the number of the holding portions 25 corresponds to the number and location of the lock 23. The holding portions 25 are formed at both sides of the position where the inner conductor 51 is mounted on the conductor mounting portion 21, by penetrating therethrough. In this way, the provisions of the stopper 23*a* and the protruding portion 23*b* in the lock 23 permit a strong restriction of the movement of the lock 23 inserted into the holding portions 25. Moreover, the lock 23 and the holding portions 25 made of an identical metal material bring an advantage that there is little variation in dimension due to heat.

Next, a third embodiment will be described with reference to FIG. 9. In the shown embodiment, only the configuration of the lock is different from that of the embodiment described for FIGS. 1-7. Therefore, descriptions of the configurations common to those will be omitted for sake of brevity.

Figure 9:
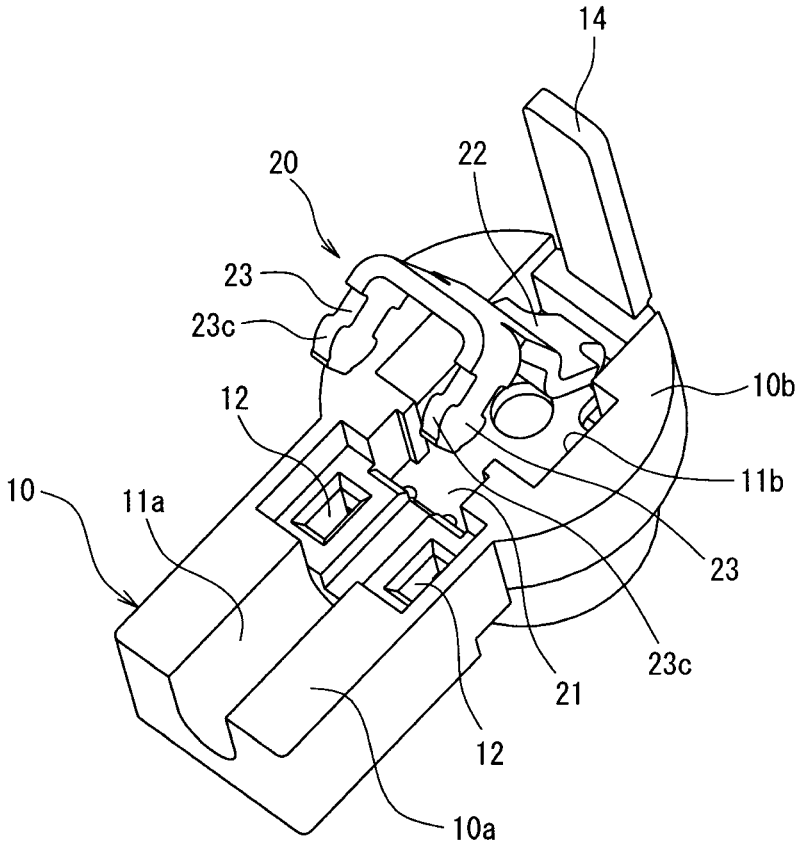
FIG. 9 is a perspective view another coaxial connector according to the invention.
Figure 10:
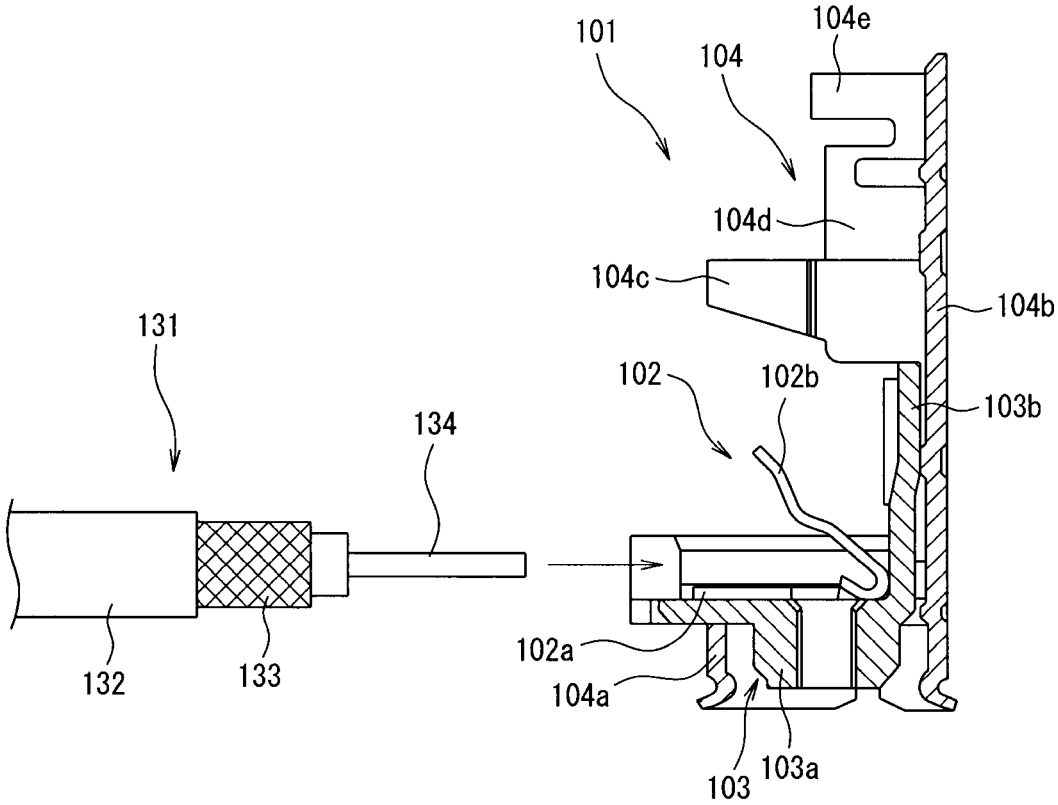
F I G. 1 0 PRIOR ART
FIG. 10 is a cross-sectional view of a known coaxial connector.
Figure 11:
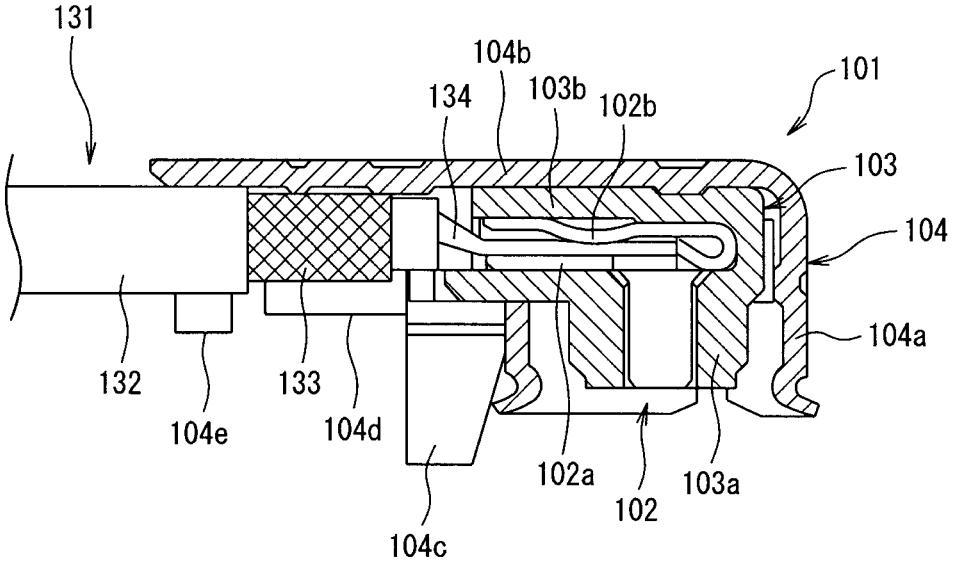
F I G. 1 1 PRIOR ART
FIG. 11 is a cross-sectional view of the known coaxial connector.

Referring to FIG. 9, in the shown embodiment, each lock 23 protruding in the width direction of the conductor holding arm 22 is bent toward the conductor mounting portion 21 side. Then, a barb 23*c* is formed to protrude at both side edges of each lock 23 that has been bent. On the other hand, the housing 10 includes the holding portion 12 having a slit shape into which the barb 23*c* of the lock 23 is press-fitted by folding the conductor holding arm 22. The dimension of the front-back direction of each holding portion 12 is set equal to or smaller than that of the lock 23. In this way, the provision of the barb 23*c* at both side edges of the lock 23 permits strong holding between the holding portion 12 and the lock 23, in the state where the inner conductor 51 is held by the conductor mounting portion 21 and the conductor holding arm 22.

Heretofore, the embodiments of the present invention have been described, but the present invention is not limited to this. It should be apparent that modifications and improvements to those embodiments may be allowed. For example, the lock 23 is not necessarily arranged at an end of the conductor holding arm 22, and the position and the number of the locks 23 are changeable as necessary.

What is claimed is:

1. A coaxial connector comprising:

a housing;

an inner contact secured to the housing;

a conductor mounting portion of the inner contact having an integrally formed conductor holding arm with a lock;

a barb protruding at a side edge of the lock;

an outer contact secured to the housing; and a holding portion disposed on the housing or the conductor mounting portion for inserting the lock therein.

2. The coaxial connector according to claim 1, wherein the holding portion includes a stopper defining a lowermost position.

3. The coaxial connector according to claim 1, wherein the outer contact includes a shell secured to the housing.

4. The coaxial connector according to claim 3, wherein the outer contact further includes a cover integrally formed with the shell for holding the housing together with the shell when the cover is folded toward the shell.

5. The coaxial connector according to claim 1, wherein the barb is engageable with the holding portion arranged in the housing.

6. A method for assembling a coaxial connector with a coaxial cable, comprising the steps of:

providing a connector having:

a housing;

an inner contact secured to the housing and having a conductor mounting portion and a conductor holding arm with a lock that is integrally formed with the conductor mounting portion;

a barb protruding at a side edge of the lock; and an outer contact secured to the housing;

positioning an inner conductor of the coaxial cable on the conductor mounting portion of the inner contact; and folding the conductor holding arm toward the conductor mounting portion such that the lock is inserted into a holding portion disposed on the housing or the conductor mounting portion and secures the inner conductor together with the conductor mounting portion.

7. The method for assembling the coaxial connector according to claim 6, wherein the outer contact includes a shell secured to the housing.

8. The method for assembling the coaxial connector according to claim 7, wherein the outer contact further includes a shell cover integrally formed with the shell.

9. The method for assembling the coaxial connector according to claim 8, further comprising a step of folding the shell cover toward the shell.

10. The method for assembling the coaxial connector according to claim 9, further comprising a step of securing the shell cover to the housing.

11. The method for assembling the coaxial connector according to claim 10, further comprising a step of connecting the shell cover to an outer conductor of the coaxial cable.

* * * * *